US005842095A

United States Patent [19]

Kitamura

[11] Patent Number: 5,842,095

[45] Date of Patent: Nov. 24, 1998

[54] IMAGE FORMING DEVICE WITH MULTIPLE IMAGE FORMING UNITS

[75] Inventor: Atsuyuki Kitamura, Ebina, Japan

[73] Assignee: Fuji Xerox Co., Ltd., Tokyo, Japan

[21] Appl. No.: 868,919

[22] Filed: Jun. 4, 1997

[30] Foreign Application Priority Data

Jun. 6, 1996 [JP] Japan ..... 8-166705

[51] Int. Cl.[6] ..... G03G 15/01

[52] U.S. Cl. ..... 399/299; 399/381

[58] Field of Search ..... 399/297, 298, 399/299, 300, 301, 303, 381, 388, 394, 395

[56] References Cited

U.S. PATENT DOCUMENTS

| | | | |
|---|---|---|---|
| 5,363,178 | 11/1994 | Matsumoto | 399/299 |
| 5,386,286 | 1/1995 | Kinouchi et al. | 399/228 |
| 5,455,668 | 10/1995 | De Bock et al. | 399/299 |
| 5,537,195 | 7/1996 | Sagara et al. | 399/381 |
| 5,581,327 | 12/1996 | Izumizaki et al. | 399/30 |
| 5,602,633 | 2/1997 | Yoshida et al. | 399/299 |
| 5,623,719 | 4/1997 | De Cock et al. | 399/299 |

FOREIGN PATENT DOCUMENTS

| | | |
|---|---|---|
| 5-53412 | 3/1993 | Japan . |
| 7-287455 | 10/1995 | Japan . |
| 7-319254 | 12/1995 | Japan . |

*Primary Examiner*—Sandra L. Brase
*Attorney, Agent, or Firm*—Oliff & Berridge, PLC

[57] ABSTRACT

The invention relates to a device for packaging and applying makeup, the device includes a rigid elongate tubular body open at one end and having an inside space suitable for containing makeup, and an applicator suitable for being received in the body. The applicator includes a stalk provided at one end with a makeup applicator element and secured at its other end to a handle that has a cap suitable for closing the opening of the body in which the applicator element is engaged. A throat is formed in the body for wringing out the applicator element while the applicator is being withdrawn. The device further includes a moving wall defining the inside space, at least in part, and capable of moving in response to a change of pressure in the space caused by the applicator being withdrawn. While the device is in use, the moving wall is subjected on the outside to atmospheric pressure.

2 Claims, 6 Drawing Sheets

41
40
42
43
44
45
30
50

341
30
34
32
342
31
331
33
332
335
334
333
24
50

IMAGE FORMING DEVICE WITH MULTIPLE IMAGE FORMING UNITS

BACKGROUND OF THE INVENTION

1. Field of the Invention

The present invention relates to an image-forming device that uses electrophotography. In particular, the present invention relates to an improvement in image-forming devices wherein a plurality of image-forming units is disposed along a copy-material transport path and toner images are copied one after another from the plurality of image-forming units to the copy material moving along the copy-material transport path.

2. Description of Related Art

An example of known technology in the field of color image-forming devices involves the "tandem" method. In this technology, a plurality of image-forming units are disposed along a horizontal paper transport path. As the paper moves along the paper transport path, the image-forming units transfer toner images onto the paper one by one to form a color image on the paper.

The tandem method of transporting the paper can use a copy roll that is disposed on each image-forming unit so that it comes into contact with a photosensitive body used for image retention. This photosensitive body and the copy roll is used to transport the paper (see, for example, Japanese Laid-open Publication Number 7-319254).

In another method, a belt is used to transport the paper (as in Japanese Laid-open Publication Number 5-53412). In this method, a paper transport belt circulates along the paper transport path. The paper is supported by the paper transport belt using electrostatic adhesion.

Also, different methods for arranging the image-forming units have been proposed. In one method, a plurality of image-forming units are disposed in a horizontal row along a horizontal paper transport path (see, for example, Japanese Laid-open Publication Number 5-53412). In another method, the image-forming units are disposed in a vertical row along a vertical paper transport path (see, for example, Japanese Laid-open Publication Number 7-287455).

However, in conventional copy roll transport methods, if the dimension separating the copy rolls of the image-forming units is wide enough, it is possible for the transport force to be applied only by the nipping between a single photosensitive body of an image-forming unit and the copy roll. The nip pressure between the photosensitive body and the copy roll cannot be set too high because it is necessary to take copying properties into consideration in addition to the paper transport properties. This results in a greater tendency for the paper to be fed diagonally (i.e., skewing).

Also, when the paper is passing through the copy position of an image-forming unit, and a lengthy section has already passed, the end of the paper can become curled, or unstable. This causes variations in the positioning of the end of the paper to the copy position for the next image-forming unit and results in shifts in the starting position at which the toner images for each color element are written to the paper. This leads to color offsets and uneven color distribution.

Furthermore, when the paper is transported solely by the nipping of the photosensitive body of the image-forming unit and the copy roll, unevenness in the thickness of the toner layer at the copying positions of the image-forming units occurs. This tends to produce variations in the speed of the paper as it passes the copy positions of the image-forming units and leads to color shifts and uneven color in the color image.

In conventional image-forming devices that use a paper transport belt, the position at which the end of the paper enters the copy positions of the image-forming units is more stable than those devices using copy rolls. The paper transport belt limits uneven color distribution along the direction of paper transport. However, as the paper transport belt moves, "walking" may take place (i.e. the paper transport belt may move back and forth along the width axis of the belt). Thus, the color image may show color shifts and uneven color distribution in the direction perpendicular to the paper transport direction (i.e., the width direction).

The present invention solves the problems in the technology described above and provides a more compact image-forming device that restricts color shifts and uneven color distribution from irregularities in the transport of the copy material.

SUMMARY OF THE INVENTION

According to a first preferred embodiment of the invention, a transport copying means for each image-forming unit comes into contact with an image retention body. Entry-side and exit-side nip transporting means are disposed upstream and downstream from the image-forming units, respectively. The distance between entry-side and the exit-side nip transporting means is shorter than the length of a standard-size copy material. Thus, the copy material can always be nipped and transported by entry-side and/or exit-side nip transporting means. This allows the copy material to be transported through the copy positions of the image-forming units at a constant speed and at a consistent entry position.

Thus, it is possible to limit the shifting and unevenness in the color that accompanies inconsistencies in the transport operations without using means for supporting and transporting copy materials such as a copy material transport belt. The device is also more compact.

In the present invention, the color material transport path can be substantially vertical and the image-forming units can be in a vertical row. This configuration provides short image-forming units and also allows the means for feeding copy material to be positioned under the image-forming units to provide a more compact package.

If copy material is transported with the copying means of the image-forming units, there may be a concern that gravity may cause problems when the copy material transport path is substantially vertical. However, the copy material is always nipped and transported by the entry-side and/or exit-side nip transporting means and, therefore, the copy material is always transported without being affected by gravity.

According to a second preferred embodiment of the present invention, a transport copying means is positioned in contact with an image retention body of each image-forming unit and the entry-side and exit-side nip transporting means are disposed upstream and downstream of the image-forming units. Therefore, a minimum-size copy material that is not being nipped by either entry-side or exit-side nip transporting means will be nipped by at least a plurality of transport copying means of the image-forming units. Thus, even if a minimum-size copy material is used, the copy material can be transported in a stable manner without a means for supporting and transporting the copy materials such as a copy material transport belt. This makes it possible to limit the shifts and unevenness in color from inconsistencies in the transport of the copy material. The device is also more compact.

In a third preferred embodiment of the present invention, copy material is supported and transported using means for supporting and transporting copy materials. Entry-side and exit-side nip transporting means are disposed upstream and downstream from the image-forming units, respectively. The distance between the entry-side and exit-side nip transporting means is shorter than the length of standard-size copy material. Thus, the copy material is always nipped by entry-side and/or exit-side nip transporting means and if the means for supporting and transporting "walks" (moves side to side gradually), the copy material is kept from moving side to side. Thus, shifts and unevenness in color from inconsistencies in the transport of the copy material are prevented, and the device can be easily made more compact.

Furthermore, according to a fourth preferred embodiment of the present invention, copy material is supported and transported using means for supporting and transporting copy materials. Transport copying means is disposed on each image-forming unit at a position corresponding to an image retention body so that the copy material is transported and put in contact with the image retention body and so that a toner image on the image retention body is copied onto the copy material. Entry-side and exit-side nip transporting means are disposed upstream and downstream from the image-forming units, respectively. When the copy material is not being nipped by either the entry-side or the exit-side nip transporting means, the copy material is nipped by at least a plurality of transport copying means of image-forming units and the means for supporting and transporting copying materials "walks" (moves side to side gradually), the minimum-size copy material is kept from moving side to side. Thus, shifts and unevenness in color that accompany inconsistencies in the transport of the copy material are prevented, and the device can be easily made more compact.

Furthermore, since a paper guide is disposed between the paper transport belt and the fixing device, greater compactness can be achieved.

BRIEF DESCRIPTION OF THE DRAWINGS

FIG. 1(*b*) is a cross-sectional plan view of a second preferred embodiment of the image-forming device of the present invention;

FIG. 3(*b*) is an enlarged cross-sectional plan view of the photosensitive cartridge of the image forming unit of FIG. 3(*a*);

DETAILED DESCRIPTION OF THE PREFERRED EMBODIMENTS

Figure 1A:
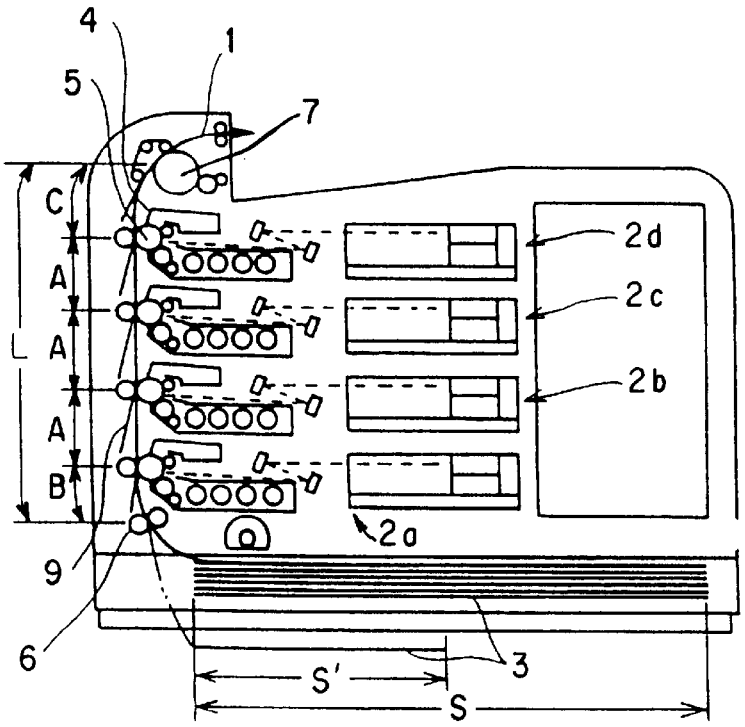
FIG. 1(*a*) is a cross-sectional plan view of a first preferred embodiment of the image-forming image-forming device of the present invention.
Figure 1B:
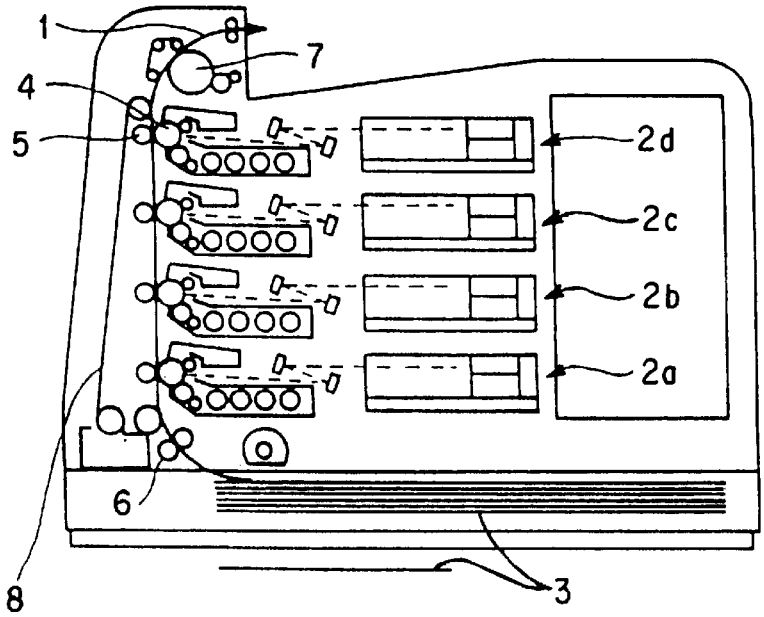

In the first preferred embodiment shown in FIG. 1(*a*) the following conditions are required: S'>2A, A+B, A+C, where: A is the interval between the plurality of image-forming units 2 along the copy material transport path 1; B is the interval between the image-forming unit 2*a*, which is positioned furthest "upstream" in transport path 1, and the entry-side nip transporting means 6; C is the interval between the "downstream" image-forming unit 2*d* and the exit-side nip transporting means 7; and S' is the length along the transport direction of a minimum-size copy material 3. Therefore, if the copy material 3 is not being nipped by either the entry-side nip transporting means or the exit-side nip transporting means 7, then it is nipped by at least a plurality of transport copying means 5 of image-forming units 2.

Dimension A is preferably uniform for all image-forming units 2 (2*a*–2*d*). However, it is also possible for some or all of the intervals to have different dimensions. If some or all of the intervals between image-forming units 2 have different dimensions, then the following conditions must be fulfilled: S'>A1+A2, A2+A3, A1+B, A3+C, where: A1is the interval A between image-forming units 2*a* and 2*b*; A2 is the interval A between image-forming units 2*b* and 2*c*; and A3 is the interval A between image-forming units 2*c* and 2*d*.

In the second preferred embodiment shown in FIG. 1(*b*), copy material support-transport means 8 is positioned and moves along copy material transport path 1. The copy material support-transport means 8 supports copy material 3. A plurality of image-forming units 2*a*–2*d* is arranged along the copy material transport path 1. In this image-forming device, the copy material 3 moves along the copy material transport path 1, and the plurality of image-forming units 2 to transfer toner images onto the copy material 3 one after another. Entry-side nip transporting means 6 and exit-side nip transporting means 7 are positioned upstream and downstream from the plurality of image-forming units 2, respectively. Copy material 3 is transported in a nipped state by nip transporting means 6, 7.

To reliably prevent transport discrepancies of standard-size copy material 3: a distance L along copy material transport path 1 between entry-side and exit-side nip transporting means 6, 7 must be shorter than a length S of standard-size copy material 3 (e.g., an A4-size copy material, as set in the JIS (Japan Industrial Standard) standards.

The copy material support-transport means 8 can comprise a transport belt or a gripper. If a gripper is used, it is necessary to temporarily retract the gripper during passage through the copying positions of the image-forming units 2 to prevent interference. Therefore, a transport belt is preferable.

It is crucial that the copying means applies transport pressure to copy material 3, therefore, copying means is not restricted to a transport copying means 5 comprising a copy roll, but can also comprise an alternative device such as a copying corotron.

As shown in FIG. 1(*b*), a transport copying means 5 is disposed on each of the plurality of image-forming units 2 at a position that corresponds to image retention body 4. Transport copying means 5 serves to transport the copy material 3 toward the image retention body 4 and to transfer the toner image on the image retention body 4 to the copy material 3.

To provide good transport characteristics for a minimum-size copy material 3, the relations S'>2A, A+B, A+C are required, where: A is the interval between the plurality of image-forming units 2 along the copy material transport path 1 (see FIG. 1(*a*)); B is the interval between image-forming unit 2*a*, which is positioned furthest upstream on the transport path, and entry-side nip transporting means 6 (see FIG. 1(*a*)); C is the interval between image-forming unit 2*a*, which is positioned furthest downstream, and exit-side nip transporting means 7 (see FIG. 1 (*a*)); and S' is the length of the minimum-size copy material 3 (see FIG. 1(*a*)). When the copy material 3 is not being nipped by either entry-side or exit-side nip transporting means 6, 7, the copy material 3 must be pinched while spanning at least a plurality of transport copying means 5 of image-forming units 2. As in the structure shown in FIG. 1(*a*), dimension A is generally set identically between image-forming units 2*a*–2*d*, but it would also be possible to set one or all of the intervals differently.

In the operation of the first preferred embodiment of the invention shown in FIG. 1(*a*), a standard-size copy material 3 (with a length S) is nipped by entry-side nip transporting means 6 and/or exit-side nip transporting means 7. When this happens, the standard-size copy material 3 receives transport force mainly from the nip transporting means 6, 7 and passes the copy positions of each image-forming unit 2. Since span A between the copy positions of image-forming units 2 is short, the entry position of the end of the copy material 3 to a copy position of an image-forming unit 2 is uniform, thus providing a stable speed at which the copy material 3 passes over the copy positions of the image-forming units 2.

In FIG. 1(*a*), if S'>2A, A+B, A+C, then even if a minimum-size copy material 3 (with a length S') is not being nipped by either nip transporting means 6 or 7, it would still be nipped and transported by at least a plurality of transport copying means 5 of the image-forming units 2.

In the second preferred embodiment of the invention shown in FIG. 1(*b*), a standard-size copy material 3 (with a length S) is transported by copy material support-transporting means 8 through the copy positions of image-forming units 2. Further, the copy material 3 is also transported by the entry-side nip transporting means 6 and/or the exit-side nip transporting means 7. Thus, even if the copy material support-transporting means 8 "walks", the displacement of the copy material 3 along its width axis would be prevented by the entry-side nip transporting means 6 and/or the exit-side nip transporting means 7.

If, in FIG. 1(*b*), S'>2A, A+B, A+C, then even if minimum-size copy material 3 (with a length S') is not nipped by either nip transporting means 6 or 7, it would still span across and be nipped by a plurality of transport-copying means 5 of the image-forming units 2. Thus, the copy material 3 is transported in a stable manner without any skewing.

Figure 2:
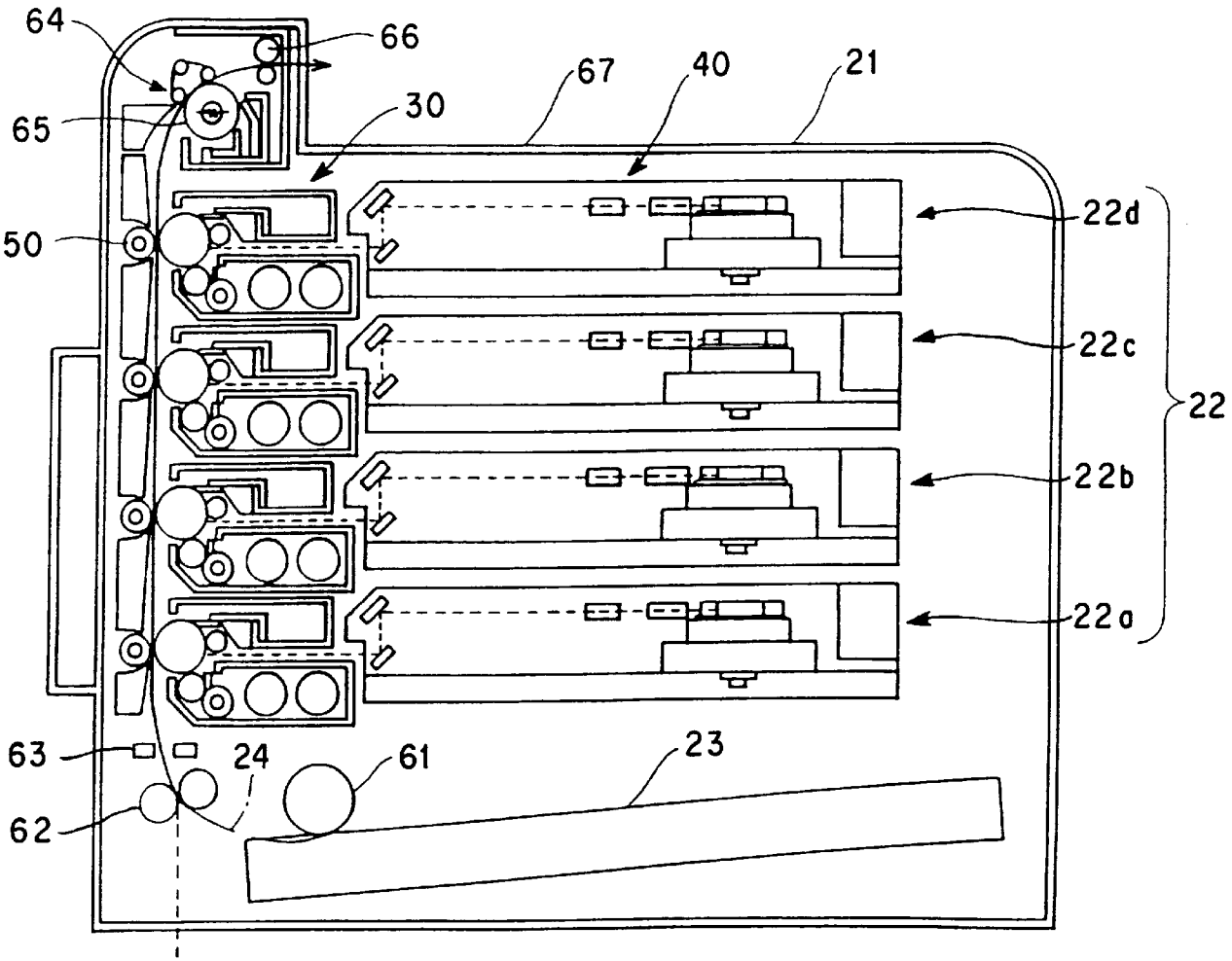
FIG. 2 is another cross-sectional plan view of the image-forming device according to the first preferred embodiment.

FIG. 2 shows another cross-sectional view of the first preferred embodiment of the color image-forming device of the present invention. Image-forming units 22 (specifically, 22*a*–22*d*) for four colors (in the preferred embodiment: yellow, magenta, cyan, and black) are arranged in a vertical row within housing 21. Below these is a paper-feeding cassette 23, in which paper is stored. A paper transport path 24 is disposed vertically along positions corresponding to the image-forming units 22.

Starting from the upstream position of paper transport path 24, the image-forming units 22 (22*a*–22*d*) form the yellow, magenta, cyan, and black toner images. There is also a photosensitive cartridge 30, a laser exposure device 40, and a copy roll 50.

Figures 3A, 3B:
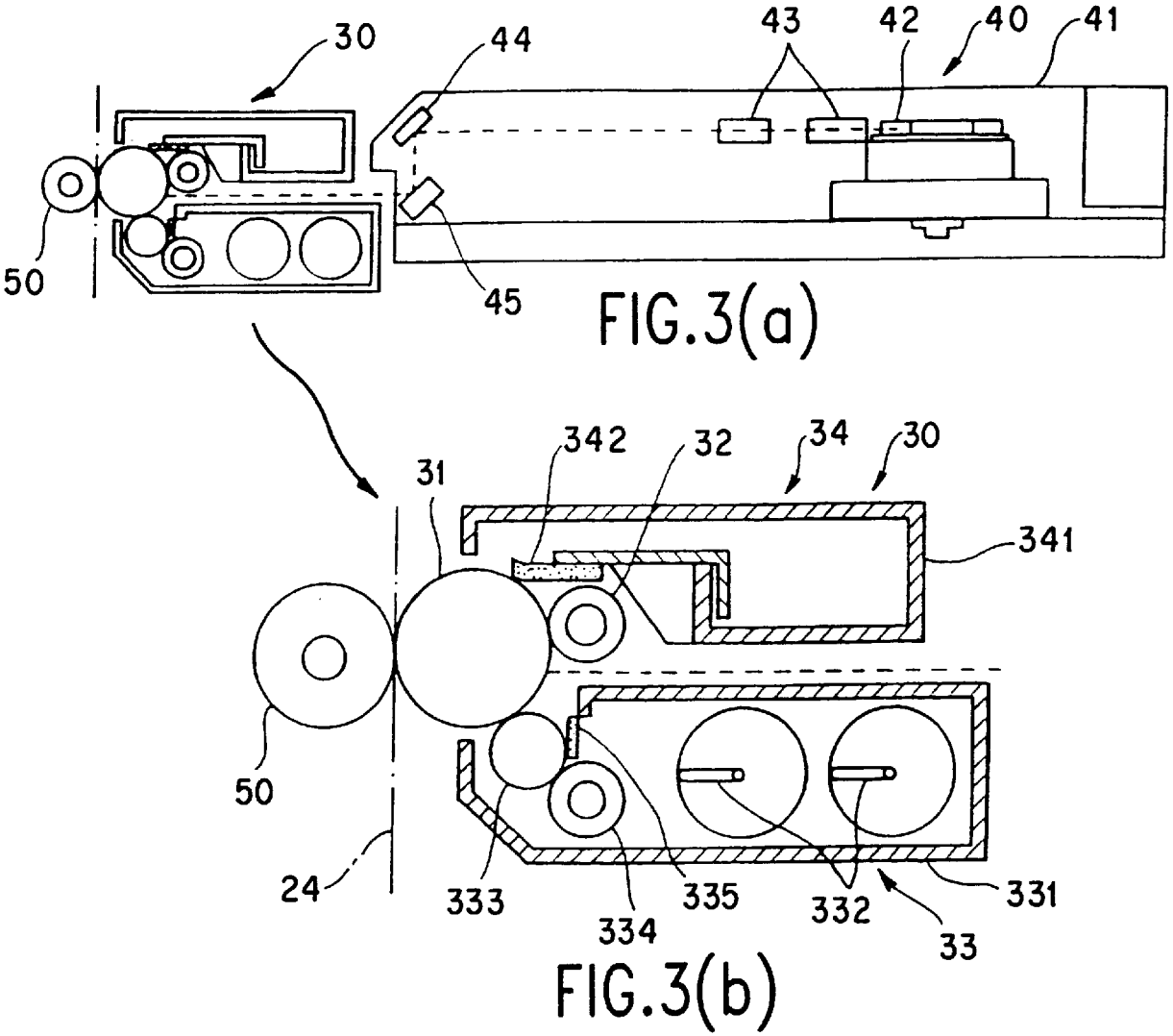
FIG. 3(*a*) is a cross-sectional plan view of an image-forming unit used in the first preferred embodiment.

As shown in FIG. 3, a photosensitive cartridge 30 is formed integrally from the following elements: a drum-shaped photosensitive body 31; a charge roll 32, for charging the photosensitive body 31; a developer 33 using a corresponding color toner to develop an electrostatic latent image that is formed on the charged photosensitive body 31 by the laser exposure device 40; and a cleaner 34, for removing the residual toner on the photosensitive body 31.

In this embodiment, the developer 33 is positioned below the photosensitive body 31 and has a developer housing 331 that extends laterally. Developer housing 331 holds a developing agent (a single-component developing agent comprising a non-magnetic developing agent or a magnetic developing agent) containing a prescribed color toner. A pair of developing agent agitating members 332 is disposed within the developer housing 331, and a developing roll 333 is disposed near the opening that faces the photosensitive body 31. A developing agent feeding member 334 is disposed near developing roll 333 to feed the developing agent in the developer housing 331 to the developer roll 333. Further, there is a thickness regulating member 335 for regulating the thickness of the developing agent on developing roll 333.

A cleaner 34 is disposed above the photosensitive body 31 and includes a cleaner housing 341 that extends laterally. A blade 342 on the cleaner housing 341 scrapes residual toner where it faces photosensitive body 31.

In this first preferred embodiment, the developer housing 331, which holds the developing agent, and the cleaner housing 341, which retrieves residual toner, are extended laterally to provide storage space and to provide a short photosensitive cartridge 30.

In the laser exposure device 40, a case 41 holds a semiconductor laser (not shown in the drawing), a polygon mirror 42, an image-forming lens 43, and mirrors 44 and 45. A light from the semiconductor laser is deflected and scanned by the polygon mirror 42. The resulting light is guided to form an exposure on the photosensitive body 31 via the image-forming lens 43 and the mirrors 44 and 45. The case 41 extends laterally to stay short.

Furthermore, the copy roll 50 is positioned separate from the photosensitive cartridge 30 and is placed in contact with the photosensitive body 31 of the photosensitive cartridge 30. The copy roll 50 is rotated in synchronization with the photosensitive body 31 by a drive transfer system not shown in the drawing. A prescribed electric field is applied to the copy roll 50 so that a transfer force is applied to the copy roll 50 that corresponds to the toner image on the photosensitive body 31. It is also possible to have the copy roll 50 assembled integrally with the photosensitive cartridge 30.

Figure 4:
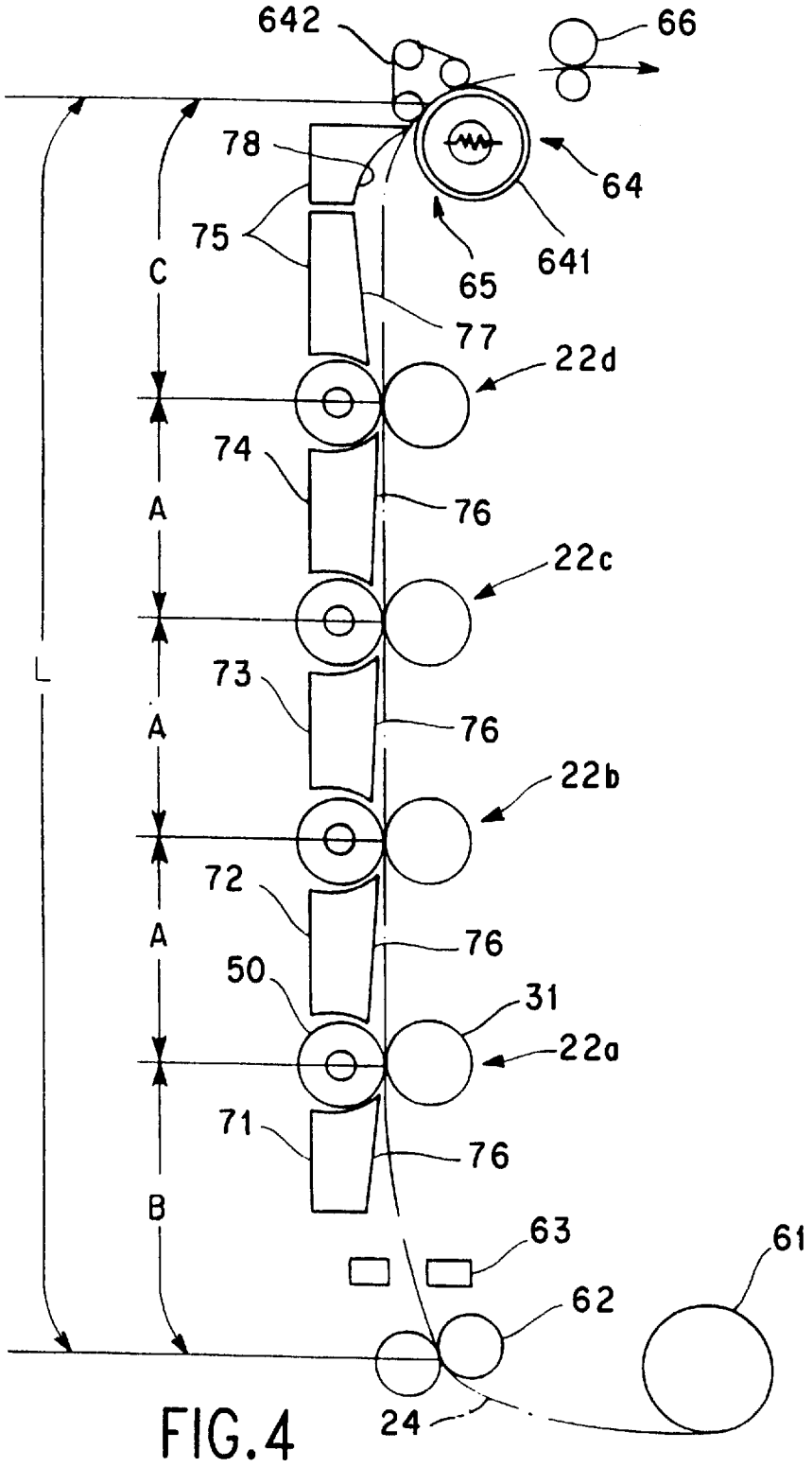
FIG. 4 is a plan view of the paper transport system of the first preferred embodiment.

In this embodiment, a paper-feeding cassette 23 is positioned on a feed roll 61 to feed paper at a prescribed timing as shown in FIG. 2 and FIG. 4. An entry-side nip transport roll 62 is positioned on a paper transport path 24 between the feed roll 61 and the image-forming unit 22*a*, that is furthest upstream. An optical paper-pass sensor 63 is disposed below the entry-side nip transport roll 62.

A paper-pass sensor 63 detects the end of the paper. It is possible to have the detection timing from the sensor be the basis for the timing at which the laser exposure devices 40 of the image-forming units 22 record electrostatic latent images.

Further, a fixing device 64 is disposed on paper transport path 24 above the image-forming unit 22*d*.

The fixing device 64 includes: a heating roll 641 and a pressure belt 642, which forms large contact nipping area with heating roll 641. This structure provides a larger nipping area than a pair of rolls and therefore, improves the fixing properties. The fixing device 64 also functions as an exit-side nip transport roll 65.

An ejection roll 66 is disposed downstream from the fixing device 64 to take up the paper. The paper that is taken up is then held in a holding tray 67 formed on top of the housing 21.

Figure 5:
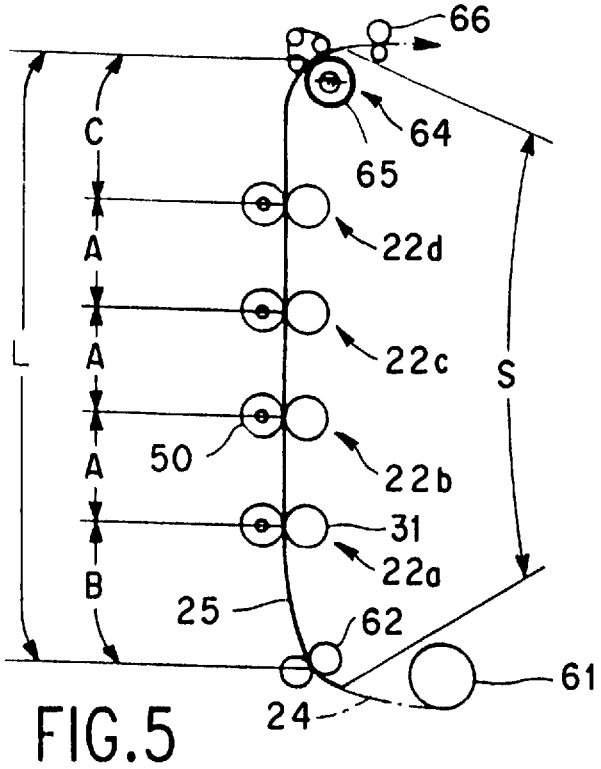
FIG. 5 is a plan view of the paper transport system when a standard-size paper is used in the image-forming device according to the first preferred embodiment.

In this embodiment, the following relationships are established:

$S>L=3A+B+C$ (see FIG. 5)

Figure 6:
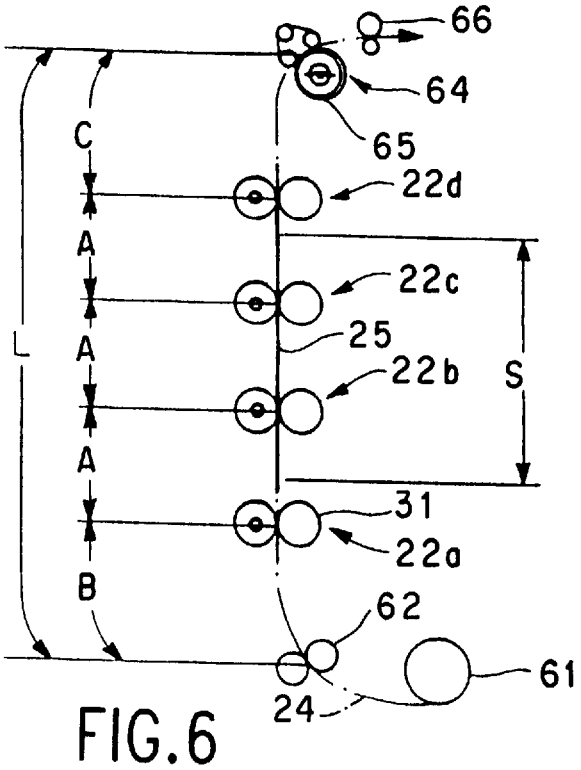
FIG. 6 is a plan view of the paper transport system when a minimum-size paper is used in the image-forming device according to the first preferred embodiment.

$S'>2A,\ A+B,\ A+C$ (see FIG. 6)

where, referring to FIG. 4: L is the distance between the entry-side nip transport roll 62 and the exit-side nip transport roll 65; A is the interval between the image-forming units 22 along paper transport path 24; B is the interval between the image-forming unit 22*a*, which is furthest upstream, and the entry-side nip transport roll 62; C is the interval between the image-forming unit 22*d*, which is furthest downstream, and the exit-side nip transport roll 65; and S is the length of a standard-size paper 25 (i.e., A4 paper based on JIS standards); and S' is the length of minimum-size paper (in this embodiment, A6 postcard size based on JIS standards).

Further, paper guides 71–75 are disposed before the image-forming unit 22*a*, which is furthest upstream, between the image-forming units 22*a*–22*d*, and past the image-forming unit 22*d*, which is furthest downstream. Paper guides 71–75 regulate the motion path of the paper.

Tapered guide surfaces 76 are formed on paper guides 71–74, which are positioned in front of the image-forming units 22*a*–22*d*. The tapered guide surfaces 76 are sloped slightly to the right from vertical and are extended in a direction that keeps them always in contact with the back surface (including the end) of the paper being copied and transported. The paper is kept in contact with the tapered guide surfaces 76 while it is moved toward the nipping area between the photosensitive body 31 and the copy roll 50. The paper path is set so that the end of the paper comes into contact with the photosensitive body 31 right before reaching the nipping area.

The paper guide 75 positioned past image-forming unit 22*d*, which is the furthest downstream, is divided in two to form a tapered guide surface 77 that is sloped slightly to the left of vertical and an arcuate guide surface 78 that is connected to the tapered guide surface 77 and oriented toward the nipping area of the fixing device 64. The end of the paper is, thereby, prevented from curling when it passes the image-forming unit 22*d*, and is reliably guided to the nipping region of the fixing device 64.

The following is a description of the operation of a color image-forming device based on this embodiment. First, a case involving a standard-size paper 25 (with a length S) is described. An image-formation start switch not shown in the drawing is pressed, and the paper 25 in the paper-feed cassette 23 is fed out by the feed roll 61. The end of paper 25 then reaches the entry-side nip transport roll 62. Paper 25 is then nip-transported by the entry-side nip transport roll 62 and is projected in sequence to the copy positions of the image-forming units 22*a*–22*d* along the paper transport path 24. The transport speed of the paper 25 is kept constant by the entry-side nip transport roll 62 so that the speed at which the paper passes the copy positions of the image-forming units 22*a*–22*d* is also kept constant.

Span A between the copy positions of the image-forming units 22*a*–22*d* and span B between the entry-side nip transport roll 62 and the copy position for the image-forming unit 22*a* are kept short relative to standard-size paper. Thus, as the paper 25 enters the copy positions for the image-forming units 22*a*–22*d*, its end region is supported by the entry-side nip transport roll 62 or the copy-nipping sections (the nipping section between photosensitive body 31 and copy roll 50) of the image-forming units 22*a*–22*c* and the position of the end of paper 25 as it enters the copy positions for image-forming units 22*a*–22*d* is stabilized. This maintains constant entry timing as paper 25 enters the copy positions for the image-forming units 22*a*–22*d* and prevents offsets in the copy positions for the different color toner images, preventing shifts in the color of the images, and preventing uneven distribution of color.

When the end of paper 25 reaches and is nipped at the fixing device 64 (exit-side nip transport roll 65), the paper 25 is nipped and transported by both the entry-side nip transport roll 62 and the exit-side nip transport roll 65. Then, as the paper 25 is transported further, the nipping action by the entry-side transport roll 62 is disengaged. However, since the paper 25 is being nipped and transported by exit-side nip transport roll 65, the transport speed stays constant. Thus, the speed at which paper 25 passes the copy positions of image-forming units 22*a*–22*d* remains constant. Then, when paper 25, on which the toner image has not been fixed, passes all the way through fixing device 64 so that the toner image is fixed, it is ejected to the holding tray 67 (see FIG. 2) by the ejection roll 66.

The following is a description of a case where a minimum-size paper 25 (with a length S') is used (see FIG. 4 and FIG. 6). An image-formation start switch (not shown in the drawings) is pressed and the paper (postcard) 25 is inserted from a manual insertion tray (not shown in the drawings) by the feed roll 61. The end of paper 25 then reaches the entry-side nip transport roll 62.

Then, paper 25 is nipped and transported by the entry-side nip transport roll 62 and enters the copy positions for the image-forming units 22*a*–22*d* along the paper transport path 24. Due to the dimensions of paper 25, the nipping operation performed by the entry-side nip transport roll 62 is disengaged when paper 25 passes across the image-forming unit 22*b*. However, the paper 25 always stays nipped and transported by at least two image-forming units 22. Also, if the paper 25 is a thick paper such as a postcard, the nipping pressure at the copy-nipping sections is greater so that the paper 25 can be transported in a stable manner, without any skewing, past the copy positions for the image-forming units 22*a*–22*d*, where the toner images are copied onto the paper 25.

When the paper 25 reaches the fixing device 64 (exit-side nip transport roll 65), the paper 25 is nipped and transported by the exit-side nip transport roll 65, and the unfixed toner images are fixed. Then, the paper 25 is ejected by the ejection roll 66 into the holding tray 67 (see FIG. 2).

The paper transport path 24 is disposed vertically, and the image-forming units 22 (22*a*–22*d*) are arranged in a vertical row. Thus, the height of the housing 21 is kept small. Further, since the paper-feed cassette 23 is disposed below the image-forming unit 22, the extra space requirements for paper-feed cassettes that project externally are avoided. Thus, a compact device can be easily provided.

Since image-forming units 22, or more specifically, photosensitive cartridge 30 and laser exposure device 40, are short and four levels can be arranged in a vertical row without an excessively large height.

If the paper transport path were disposed horizontally and the image-forming units were disposed in a horizontal row, it would be necessary to decrease the horizontal dimension of the photosensitive cartridge 30 and the laser exposure device 40. However, if the housing for the developer or the cleaner is formed with a larger height, a more complex structure is required for the developing agent to be fed or the developing agent to be cleaned by the cleaner. Also, in laser exposure device 40, the polygon mirror must be horizontal to stably drive the polygon mirror and, therefore, creates an obstacle to minimizing the horizontal dimension.

Figure 7:
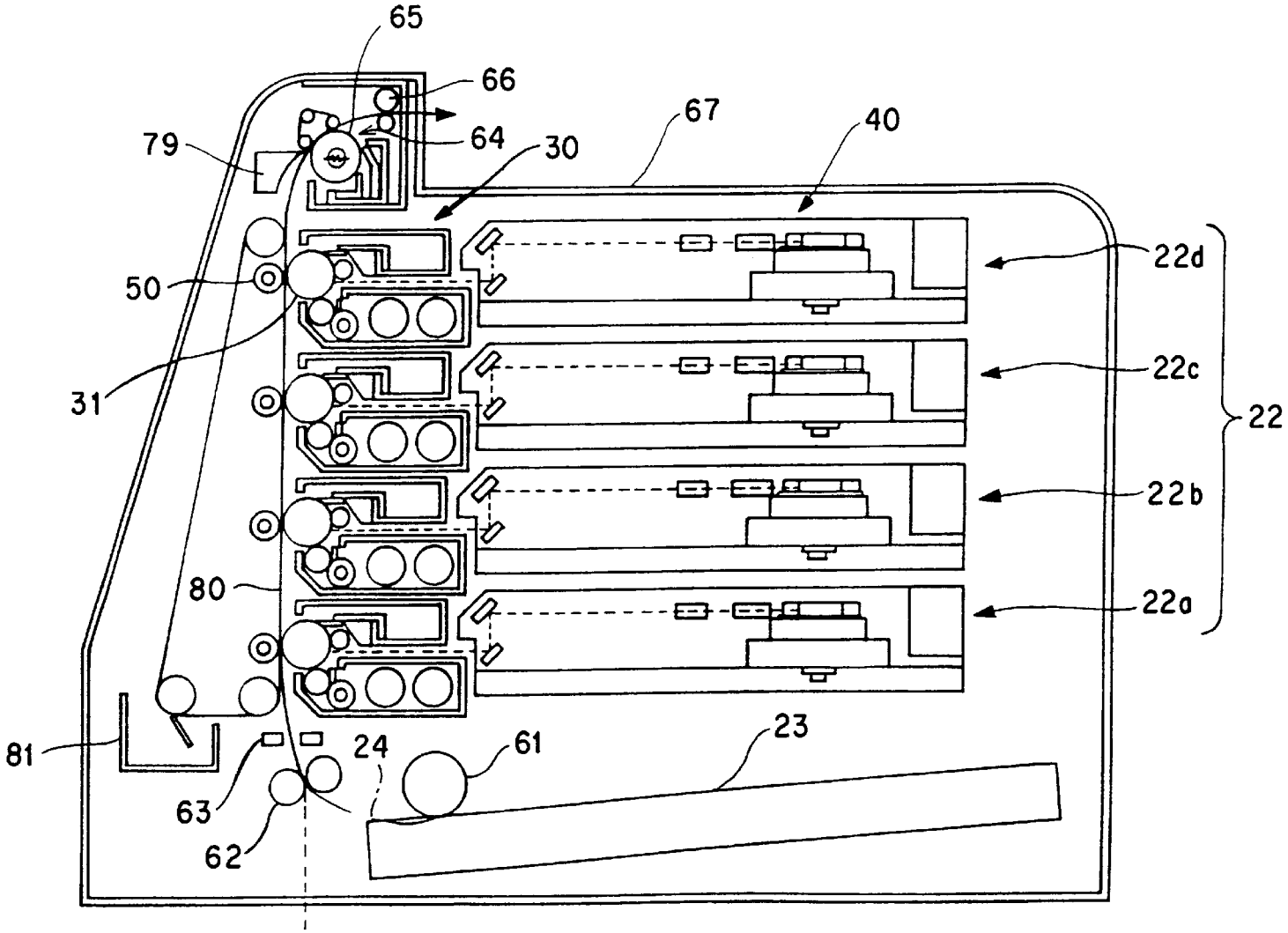
FIG. 7 is a cross-sectional plan view of the image-forming device according to a second preferred embodiment.

In the second preferred embodiment shown in FIG. 7, the color image-forming device includes image-forming units 22 (22*a*–22*d*) for four colors identical to the first embodiment will be assigned like numerals and detailed descriptions will be omitted. A circulating paper transport belt 80 is disposed along a vertical paper transport path 24. An electrostatic adhesion roll (not shown in the drawing) electrostatically adheres the paper to the paper transport belt 80, and then the paper is transported through the copy positions of the image-forming units 22 (22*a*–22*d*). A belt cleaner 81 for removing paper particles on paper transport belt 80 is also shown.

In this second preferred embodiment, the copy rolls 50 corresponding to the photosensitive bodies 31 of the image-forming units 22 (22*a*–22*d*) are disposed on the back surface of the paper transport belt 80. The copy roll 50 and the photosensitive body 31 nip and support the paper on the paper transport belt 80.

Unlike the first embodiment, this embodiment does not require paper guides along paper transport path 24. A paper guide 79 is disposed solely between the paper transport belt 80 and the fixing device 64 to guide the paper to the nipping region of the fixing device 64.

The entry-side nip transport roll 62, the copy-nipping sections (the nip sections between the copy rolls 50 and the photosensitive bodies 31) of the image-forming units 22, and the relative positioning (relative dimensions) of the exit-side nip transport roll 65 along the paper transport path 24 are the same as the first embodiment.

The following is a description of the operation of the color image-forming device of the second preferred embodiment. In this description, a standard-size paper is used. The paper is transported by the paper transport belt 80 through the copy positions of the image-forming units 22 (22*a*–22*d*). The paper is always nipped and transported by either the entry-side nip transport roll 62 or the exit-side nip transport roll 65. Thus, even if the paper transport belt 80 "walks", the paper on transport belt 80 does not walk.

Thus, the "walking" of the paper transport belt 80 does not affect the paper on the paper transport belt 80, and the paper is able to move along the transport direction at a fixed speed. This allows the color toner images from image-forming units 22 to be layered without offset, thereby resulting in a color image without any shifting or unevenness.

When a minimum-size paper is used, it is supported by the copy-nip section of at least two image-forming units 22. Thus, even if the paper transport belt 80 "walks", the paper on paper transport belt 80 does not, and shifting along the width axis is prevented. Therefore, with minimum-size paper, color toner images from image-forming units 22 can be layered without offsets, thereby providing a color image without any shifting or unevenness.

In this technology, image-forming units 2*a*–2*d* can comprise any type of unit as long as they form toner images for each color component and retain the images on an image retention body 4. However, it is preferable to have the peripheral parts for the image retention body 4 to take the form of cartridges as much as possible for ease of installation.

Also, the image retention body 4 can comprise any type of body that can retain a toner image. Any appropriate material corresponding to the means for forming latent images can be used, such as a photosensitive body or a dielectric. The form taken by the image retention body 4 is not specified, and can be drum or belt-shaped.

The form of the transport copying means 5 is not specified as long as it can copy a toner image to the copy material 3 while applying a transport force to the copy material 3. However, it is preferable to use a copy roll to which a copying electric field is applied for simplicity and compactness.

Further, referring to FIG. 1(*a*), there is no need to have anything disposed in front of the image-forming units 2 if the copy material 3 is transported by the transport copying means 5 of the image-forming units 2*a*–2*d*. However, to provide a more stable transport of the copy material 3, it is preferable to dispose the copy member guides 9 in front of the image-forming units 2*a*–2*d* so that the copy material 3 is guided between the image retention body 4 and the transport copying means 5.

The direction in which the image-forming units (2*a*–2*d*) are arranged can correspond with the arrangement of the copy material transport path 1. For example, if the copy material transport path 1 is disposed in a substantially horizontal orientation, then the image-forming units 2 would need to be arranged sideways. If the copy material transport path 1 is disposed in a substantially vertical orientation, then the image-forming units 2 would need to be arranged vertically. In this case, it is preferable to position the copy material transport path 1 in a substantially vertical orientation, and to have the image-forming units 2 arranged vertically to keep the device compact.

Any structure can be used for the entry-side and exit-side nip transporting means 6, 7 as long as the transport force applied by the nip pressure can reliably transport the copy material 3 in the transport direction. There is no problem in having separate means for each function, but it is preferable to have the exit-side nip transporting means 7 also serve as the fixing means to simplify structure.

The fixing means can take on various forms including a pair of fixing rollers and a combination of a fixing roller and a fixing belt.

The specific sequence in the arrangement of image-forming units (2*a*–2*d*) is not specified, but it is preferable for the last image-forming unit to form the black toner image to maintain image quality in a monochrome-black mode.

While this invention has been described with the specific embodiments outlined above, many alterations, modifications and variations are apparent to those skilled in the art. Accordingly, the preferred embodiments described above are illustrative and not limiting. Various changes may be made without departing from the spirit and scope of the invention as defined in the following claims.

What is claimed is:

1. An image-forming device comprising:

a plurality of image-forming units disposed along a copy material transport path, wherein said plurality of image-forming units sequentially copies toner images onto a copy material moving along said copy material transport path;

transport copying means for each image-forming unit for transporting said copying material while being placed in contact with an image retention body and so that toner images are copied from said image retention body onto said copy material;

entry-side transporting means disposed upstream from said plurality of image-forming units along said copy material transport path; and exit-side nip transporting means disposed downstream from said plurality of image-forming units along said copy material transport path, wherein a relationship S'>2A, A+B, A+C is fulfilled, wherein: A is the interval separating each of said plurality of image-forming units along said copy material transport path; B is the interval between one of the plurality of said image-forming units that is positioned furthest upstream, and said entry-side nip transporting means; C is the interval between one of the plurality of said image-forming units which is positioned furthest downstream and said exit-side nip transporting means; and S' is the length of a minimum-size copy material along the direction of transport, wherein when said copy material is not being nipped by either said entry-side or said exit-side nip transporting means then said copy material spans and is nipped by at least a plurality of said transport copying means of said image-forming units.

2. An image-forming device comprising:

means for supporting and transporting copy materials moving along a copy material transport path and supporting a copy material;

a plurality of image-forming units disposed along said copy material transport path, wherein said plurality of image-forming units sequentially copies toner images onto said copy material moving along said copy material transport path;

transport copying means for each image-forming unit at a position corresponding to an image retention body so that said copy material is transported and put in contact with said image retention body and a toner image on said image retention body is copied onto said copy material;

entry-side nip transporting means disposed upstream from said plurality of image-forming units along said copy material transport path; and exit-side nip transporting means disposed downstream from said plurality of image-forming units along said copy material transport path, wherein a relationship S'>2A, A+B, A+C is fulfilled, wherein: A is the interval separating each of said plurality of image-forming units along copy material transport path; B is the interval between one of said plurality of image-forming units that is positioned furthest upstream and said entry-side nip transporting means; C is the interval between one of said plurality of image-forming units which is positioned furthest downstream and said exit-side nip transporting means; and S' is the length of a minimum-size copy material along the direction of transport, wherein when said copy material is not being nipped by either said entry-side or said exit-side nip transporting means then said copy material spans and is nipped by at least a plurality of said transport copying means of said image-forming units.

* * * * *